US006158258A

United States Patent [19]

Bowman

[11] Patent Number: 6,158,258

[45] Date of Patent: Dec. 12, 2000

[54] RINSING SYSTEM

[76] Inventor: David Alan Bowman, Low Hall, Alne, York Y06 2LW, United Kingdom

[21] Appl. No.: 09/217,483

[22] Filed: Dec. 21, 1998

Related U.S. Application Data

[63] Continuation of application No. PCT/EP97/03222, Jun. 20, 1997.

[30] Foreign Application Priority Data

Jun. 21, 1996 [GB] United Kingdom ..... 96 13050

[51] Int. Cl.[7] ..... D06F 17/00

[52] U.S. Cl. ..... 68/205 R; 68/213; 134/191; 134/201

[58] Field of Search ..... 15/264, 262; 134/195, 134/190, 191, 201; 68/231, 213, 205 R, 205 D

[56] References Cited

U.S. PATENT DOCUMENTS

| | | | |
|---|---|---|---|
| 1,105,054 | 7/1914 | Shipherd | 134/195 |
| 1,557,983 | 10/1925 | Coker et al. | 68/205 R |
| 1,858,894 | 5/1932 | Johnston | 68/205 R |
| 2,119,686 | 6/1938 | Pribyl | 15/262 |
| 2,408,749 | 10/1946 | Berg | 68/205 D |
| 3,045,462 | 7/1962 | Brown . | |
| 3,355,750 | 12/1967 | Wisdom | 68/205 D |
| 3,611,758 | 10/1971 | Miller et al. | 68/205 D |
| 3,687,102 | 8/1972 | Dunn . | |
| 3,779,367 | 12/1973 | Hope et al. | 68/205 R |
| 3,796,186 | 3/1974 | Bounds et al. | 68/205 R |
| 3,815,872 | 6/1974 | Dunn . | |
| 3,955,528 | 5/1976 | Bounds et al. . | |
| 4,125,119 | 11/1978 | Haas | 134/191 |
| 4,135,269 | 1/1979 | Marston | 15/262 |
| 4,252,079 | 2/1981 | Quearry . | |
| 4,280,344 | 7/1981 | O'Connor . | |
| 4,888,847 | 12/1989 | Montijo . | |
| 5,428,860 | 7/1995 | Hurt . | |

FOREIGN PATENT DOCUMENTS

| | | |
|---|---|---|
| 916370 | 12/1972 | Canada . |
| 0394801A1 | 10/1990 | European Pat. Off. . |
| 0609187A1 | 8/1994 | European Pat. Off. . |
| 2187266 | 1/1994 | France . |
| 29700710 U 1 | 8/1997 | Germany . |
| 1520839 | 9/1978 | United Kingdom . |
| 2036549 | 7/1980 | United Kingdom . |
| WO89/1241 | 12/1989 | WIPO . |

*Primary Examiner*—Frankie L. Stinson
*Attorney, Agent, or Firm*—Harness, Dickey & Pierce, P.L.C.

[57] ABSTRACT

A container (10) for use in rinsing out dirt from a cleaning cloth comprises a compartment (12) adapted to hold water, means for providing fresh water, a structure (34) adapted to receive the cleaning cloth to be rinsed, and at least one nozzle (32) for supplying water free of dirt onto the cleaning cloth (FIG. 1).

22 Claims, 5 Drawing Sheets

RINSING SYSTEM

CROSS REFERENCE OF PENDING APPLICATION

This is a continuation of pending international application PCT/EP97/03222 filed on Jun. 20, 1997.

BACKGROUND OF THE INVENTION

1. Field of the Invention

The present invention relates to a unique, purpose designed bucket or container for use in rinsing out dirt from cleaning cloths, mop heads and the like.

2. Related Prior Art

When cleaning surfaces with a cleaning cloth or cleaning fabric it is usual to use a detergent or cleaning agent in the water used for rinsing the cleaning cloth. The detergent helps to dissolve grease and lift dirt from the surface. For convenience the rinsing water and the detergent are held in a bucket which can be moved around easily as the surface is cleaned. Whenever the cleaning cloth becomes heavily loaded with dirt it is rinsed out in the bucket and wrung dry to transfer dirt from the cleaning fabric into the water.

Although not readily appreciated, this cleaning technique is far from efficient. Each time the cleaning cloth is rinsed some dirt is transferred into the water. After several rinsing cycles the rinsing water becomes loaded with dirt in that it is impossible to rinse the cleaning cloth effectively. Detergents, which are considered essential with most cleaning fabrics, to help clean the surface and the cleaning fabric itself, can actually add to the problems. Not only do detergents leave a film of dirt and detergent on the surface, which has been cleaned, but they also hold the dirt in the rinsing water thereby allowing it to be picked up on the cleaning cloth each time it is rinsed. Only by changing the water regularly can the problem be overcome satisfactorily.

Moreover, detergents and cleaning agents are, almost without exception, damaging to the environment and costly.

A new type of cleaning cloth is now available as disclosed in German patent DE 43 19 939 C2 which makes detergents and cleaning agents unnecessary. The fabrics comprising this cleaning cloth are able to pick up dirt from a surface using only water and can be effectively purged of dirt simply by rinsing in clean water.

This new type of cleaning cloth can be rinsed under the tap, but this is not very satisfactory. A bucket or container holding clean water can be used to rinse it, but this soon becomes loaded with dirt, making frequent changing necessary.

It the object of the present invention to provide a container in which cleaning cloths can be rinsed effectively.

SUMMARY OF THE INVENTION

According to the present invention there is provided a container for use in rinsing out dirt from a cleaning cloth comprising a compartment adapted to hold water, means for providing fresh water, a structure adapted to receive the cleaning cloth to be rinsed and at least one nozzle for supplying water free of dirt onto the cleaning cloth.

When water free or dirt is supplied through nozzles directly onto the cleaning cloth a thorough rinsing of the cleaning cloth can be achieved in a short period of time. It is an important feature of the invention that always water free of dirt, i. e. fresh water is supplied onto the cleaning cloth. The fresh water supplied onto the cleaning cloth serves for both rinsing and moistening the cloth for the next cleaning procedure.

The fresh water can either be supplied from an external fresh water source to the container or be prepared in situ within the container from the dirty water resulting from the rinsing process.

Thus the container of the invention allows for a cost and time effective rinsing of all kinds of cleaning cloths with high efficiency.

The object of the present invention is thus perfectly solved.

The new type of container can be obviously be used for rinsing all different kinds of cleaning cloths, mop heads and the like in combination with or without detergents, although it is most efficiently used for rinsing the above mentioned cleaning cloth available under the trademark kiraWisch.

In a preferred embodiment at least one nozzle is designed for spraying water free of dirt onto the cleaning cloth.

Spraying water onto the cleaning cloth allows for a highly effective rinsing of the cleaning cloth. Since the water free of dirt is sprayed onto the cleaning cloth under a certain pressure dirt particles associated with the cleaning cloth are readily swept off.

In another preferred embodiment of the invention at least one nozzle is arranged on a spray bar.

This embodiment is advantageous since a number of nozzles can be mounted onto a spray bar. Using a hose connected to the spray bar the nozzles can be fed with water easily. It is appreciated that not only one, but two or more spray bars carrying nozzles can be used in connection with the container of the invention. With respect to the present invention the term nozzles also comprises simple holes through which water is sprayed.

To another preferred embodiment at least one nozzle is arranged in a fixed position within said container.

The cleaning fabric can be moved relative to the nozzles in order to achieve efficient rinsing. Nozzles arranged in a fixed position allow for a simple construction of the container according to the invention. Such an arrangement is particularly suitable for rinsing floor cleaning mops mounted on a handle, where the handle may be used to push and pull the mop head along the spray nozzles.

In another preferred embodiment, at least one nozzle is movably arranged within the container.

This embodiment is advantageous in combination with heavy cleaning tools having cleaning cloths attached which have to be rinsed extensively. The possibility of moving the nozzles relative to the cleaning cloth spares the cleaning person the frequent up and down movement of the cleaning tool.

In a further preferred embodiment several nozzles are connected to a spray support.

The use of a spray support provides a simple constructural means for mounting an array of nozzles. The nozzles can be disconnected from the spray support so as to exchange defective nozzles easily and to allow for easy cleaning of dirty or blocked nozzles.

In a further embodiment a spray arm having several nozzles is provided and said spray arm is mounted on said spray support.

This embodiment is advantageous because all the different elements of the spraying system are held together in a compact form. Furthermore the elements of the spraying system can be disconnected from each other so as to be cleaning and exchanged easily.

In a further preferred embodiment the spray support is detachably mounted onto the container.

The spray support can be withdrawn from the container, in particular for inspecting or cleaning the entire spray system.

In a highly preferred embodiment wringing means for wringing out the cleaning cloth is provided.

Wringing out the cleaning cloth is advantageous in order to effectively remove dirt dissolved in water from the cleaning cloth. Wringing out the cleaning cloth first before spraying of rinsing water renders the rinsing much more efficient since most of the dirty water associated with the cleaning cloth has been removed by wringing out.

The cleaning cloth is mechanically pressed to the wringing means, representing the simplest way for wringing out the cleaning cloth.

Preferably the wringing means is a roller bar, allowing for thoroughly wringing out water of cleaning cloths comprising various materials and shapes. It is further preferred that the roller bar is mounted at a top end of said structure for receiving the cleaning cloth to be rinsed.

In a further highly preferred embodiment the structure adapted to receive the cleaning cloth comprises guiding means for guiding the cleaning cloth along the roller bar during inserting the cleaning cloth into the container.

It is further preferred that the structure adapted to receive the cleaning cloth comprises a carrier adapted to receive a tool having attached the cleaning cloth thereon.

This embodiment allows for a most easy handling of the cleaning cloth during rinsing, since the carrier is designed to receive and hold tools.

In a highly preferred embodiment the carrier is movable between a first position retracted away from the container and a second position pushed into the container, the cleaning cloth being rinsed with water free of dirt in said second position of said carrier.

This embodiment is highly advantageous because the cleaning cloth can be inserted into the structure for receiving it in an accessible, exposed position and then the cleaning cloth together with the carrier is pushed into the container, for example via the tool connected to the cleaning cloth. Then rinsing is performed inside the container without spilling or spraying of water onto the floor.

It is preferred that the roller bar is mounted in face of the carrier at a distance providing a gap for wringing the cleaning cloth while moving the carrier.

This embodiment allows for sweeping off dirty water before rinsing occurs. It also guarantees removal of excessive water when the cleaning cloth is pulled out of the container. Obviously, the whole process of moving the carrier together with the cleaning cloth from the first to the second position and back again can be performed using a tool like for example a stick, which fits into recesses of the carrier.

In a further preferred embodiment the container of the invention comprises a cover.

It is advantageous that the cover prevents spraying around or spilling of dirty water during the process of rinsing.

It is further preferred that the container comprises wheels.

It is advantageous that the container can be moved around easily.

According to a further embodiment said means for providing fresh water comprises a fresh water inlet pipe connected to a hose leading to the nozzles and a water outlet pipe for discharging dirty water from the compartment.

Such a container ensures a constant supply of clean water for rinsing by connecting the water inlet to a water tap sending out water under a sufficient pressure to be sprayed from the nozzles directly onto the cleaning cloth. The water just drops or drains off from the cleaning cloth together with dirt particles. Dirty water is then discharged through the water outlet, which is advantageously arranged in the bottom part of the container.

According to a further embodiment the container comprises a pump for pumping water from the compartments to the nozzles.

This embodiment is advantageous in that the container can be moved around freely and is independent of a constant connection to the fresh water source. The water free of dirt needed to be sprayed over the cleaning cloth can for example be provided in a compartment of the container representing a fresh water reservoir, whereas the dirty water draining off the cleaning cloth during rinsing is collected in a second compartment.

The pump used in connection with the present invention can be provided as an electrically operated pump, a foot or a hand operated pump. Physically operated pumps are preferred in situations where there is no electricity supply. A hand operated pump being provided in a top portion of the container can be easily handled by the cleaning person.

In a further highly preferred embodiment said means for providing fresh water comprises filter means for filtering dirty water resulting from the rinsing process.

This highly preferred embodiment represents a self-supporting rinsing system which is completely independent of a constant water supply or a repeated renewal of a fresh water reservoir.

The filter means can be provided downstream or preferably upstream of the pump. The latter embodiment is advantageous in that there is no risk of soiling the pump with dirty water.

It is preferred that the filter means comprises pores greater than microns in size.

Such filter means will be adequate for most commercial and domestic situations wherein the water has to be cleaned of dirt particles which are generally greater than microns in size.

However, in situations requiring a higher than normal level of cleanliness such as in a hospital it is also preferred that the filter means comprises pores smaller than microns in size.

Such filters allow for a highly effective filtration not only of dirt particles but also of micro-organism like bacteria, funghi and the like.

Such filters can for example be carbon filters available with pores of different diameters.

According to another embodiment of the invention the container comprises means for mechanically agitating the water in the container.

In providing agitating means the water is most efficiently drained off and fed into the pump and/or the filter means, respectively, and dirt particles are prevented from settling down in the bottom part of the container, thus adding to an easy cleaning of the container after having been used.

Various mechanisms may be employed to agitate the water within the container. The container adapted to hold water can be connected to a motor in such a way as to cause it to vibrate, or a motor driven water stirring device can be provided within the container. Even ultrasonic vibration may be employed to agitate the water.

In a further preferred embodiment the means for providing fresh water comprises a fresh water compartment and at least one nozzle is designed as an outlet of the compartment allowing the water to be splashed onto the cleaning cloth under gravity.

This embodiment is advantageous since it represents a simple but effective mode of thoroughly rinsing the cleaning cloth. There is no need of a pump or filter unit to be included in the container. In splashing a certain amount of water over the cleaning cloth the dirt particles are flushed away efficiently. Dirty water simply flows down into the bottom compartment of the container under gravity, where it remains without having to be exchanged to fresh water.

BRIEF DESCRIPTION OF THE DRAWINGS

Embodiments of the present invention will now be described, by way of example, with reference to the accompanying drawings in which.

DETAILED DESCRIPTION OF A PREFERRED EMBODIMENT

Figure 1:
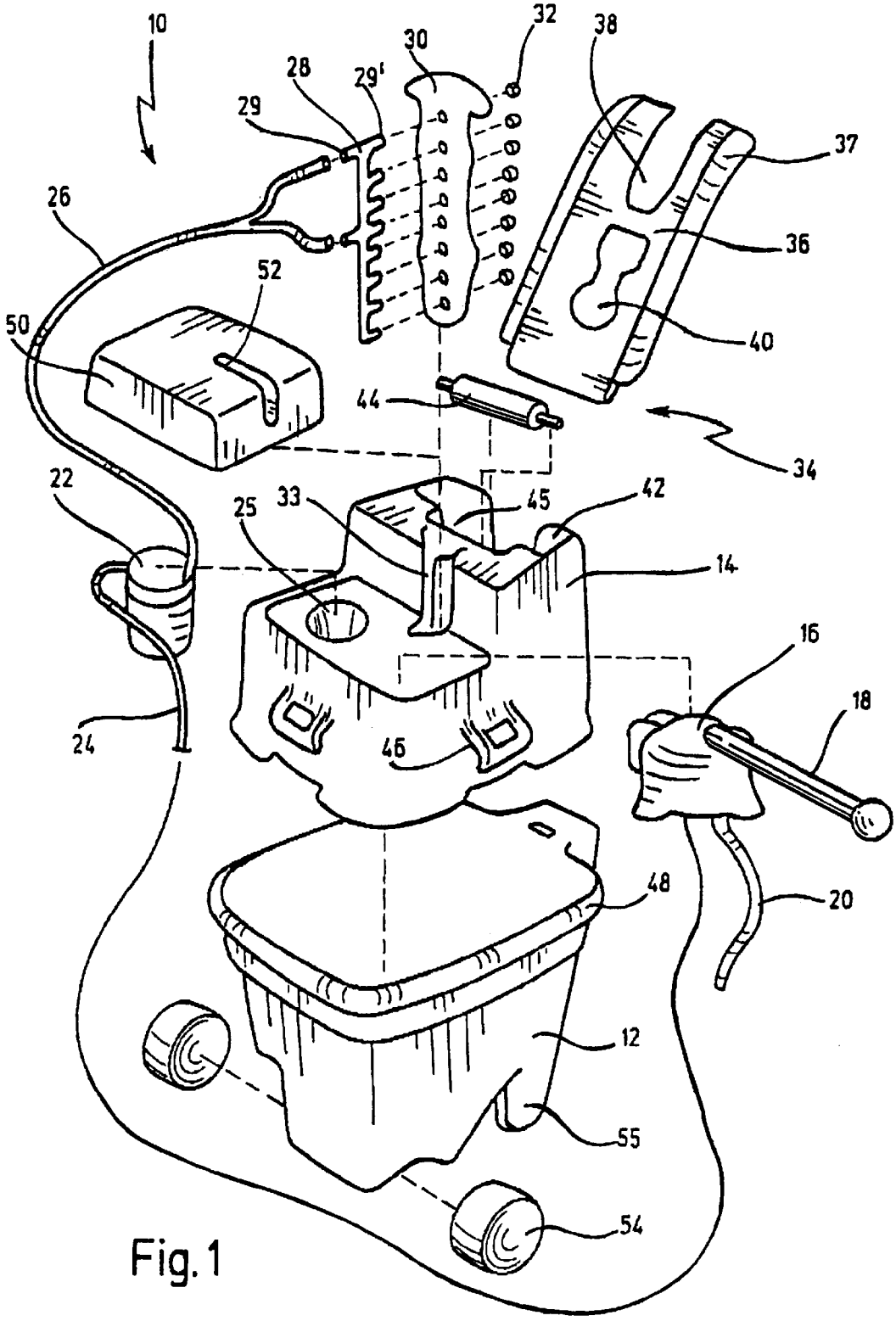
FIG. 1 shows an exploded view of a container according to the invention.
Figure 2:
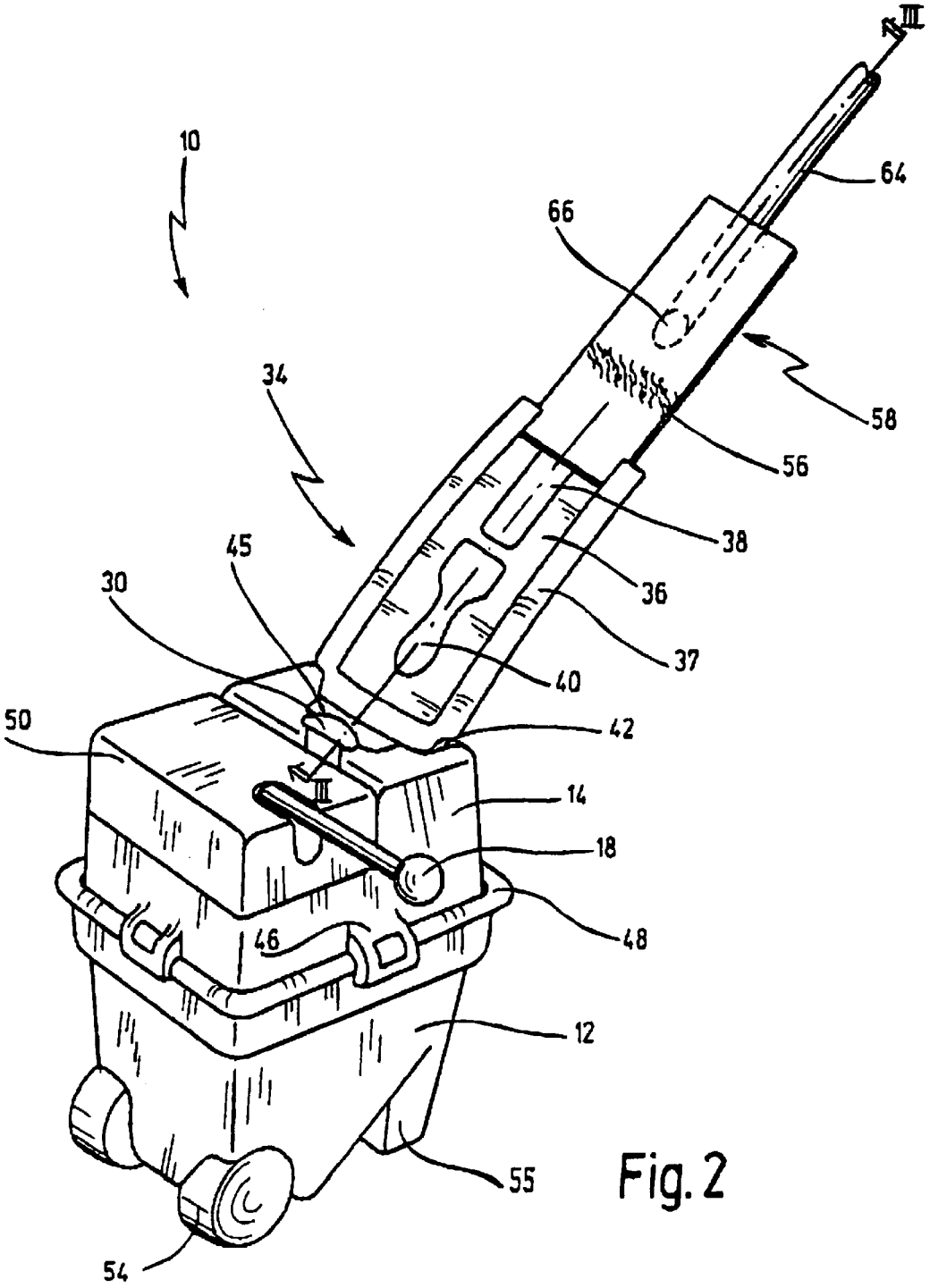
FIG. 2 shows a perspective view of the container shown in FIG. 1 together with part of a cleaning tool.

The container 10 shown in FIGS. 1 and 2 comprises a main compartment 12 adapted to hold water and an upper body 14 designed to carry various further components of the container 10 according to the invention.

One of the components carried by the upper body 14 is a pump 16 comprising a handle 18 and a suction hose 20. The pump 16 is a hand operated pump, which is operated by the cleaning person through the handle 18. It is appreciated that the pump 16 can be replaced by a foot operated pump or an electrically operated pump.

The container 10 further comprises a filter unit 22 connected to the pump 16 via a hose 24. The filter unit 22 is mounted in a hole 25 provided in the upper body 14.

Another hose 26 leading out of the filter unit 22 is connected to a spray arm 28 having two inlet pipes 29 and an array of eight outlet pipes 29'. The spray arm 28 is connected to a spray support 30 comprising a number of holes corresponding to the eight outlet pipes 29'. Spray nozzles 32 are connected to the ends of the outlet pipes 29'.

The spray support 30 is inserted together with the spray arm 28 and the spray nozzles 32 into an opening 33 in the upper body 14.

The container 10 further comprises a structure 34 adapted to receive a cleaning cloth. The structure 34 comprises a carrier 36 having lateral bulged edges 37, a recess 38 and a hole 40 as well as guiding means 42.

Figure 3:
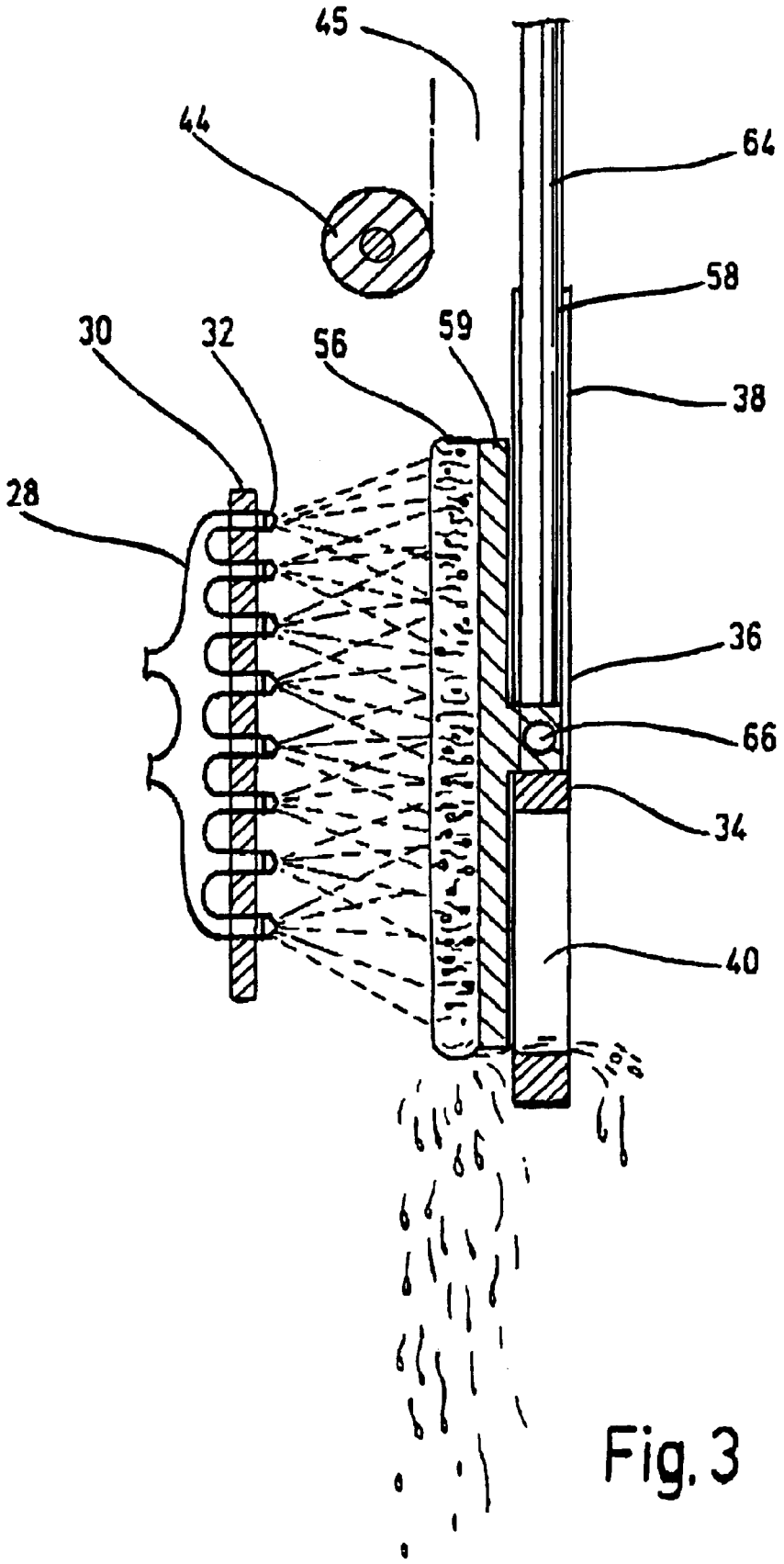
FIG. 3 shows a section along line III—III in FIG. 2 with the carrier pushed into the container.

A roller bar 44 is provided as wringing means leaving a gap 45 between the roller bar 44 and the structure 34 (see FIG. 3).

The upper body 14 of the container 10 is detachably mounted onto the compartment 12 using clips 46 engaging a bulged upper edge 48 of the compartment 12.

A cover 50 covers the upper compartment 12 and contains a hole 52 through which the handle 18 of the pump 16 is protruding.

The compartment 12 further comprises two front wheels 54 and a small foot 55.

A cleaning tool 58 is shown in FIG. 2. It comprises a cleaning cloth 56 connected to a stiff plate 59 (not seen in FIG. 1 and 2) being attached to a handle or stick 64. It is appreciated that the cleaning tool 58 can be a mop head or any other cleaning tool and that the cleaning cloth can comprise the fabric available under the trade mark keraWisch or any other appropriate cleaning fabric.

Rinsing a cleaning cloth using the container 10 of the invention is performed as follows:

The cleaning tool 58 is placed onto the carrier 36 and is secured within the bulged lateral edges 37 of the carrier 36 as shown in FIG. 2. The handle 64 is connected to the plate 59 via an articulation 66. For the rinsing process, the plate 59 is turned about the articulation into a position extending along the longitudinal axis of the handle.

The handle 64 and its articulation 66 fit into the recess 38 of the carrier 36 serving as a seat for the handle 64. This construction allows for pushing the carrier 36 together with the cleaning tool 58 within guiding means 42 down into the upper body 14 of the container 10. The plate 59 may have other protrusions (not shown) fitting into the hole 40.

FIG. 3 illustrates the processes occurring inside the upper body 14.

While pushing down the carrier 36 the cleaning cloth 56 is inserted into the gap 45 and concomitantly pressed against the roller bar 44 provided in the top part of the upper body 14. By pressing the cleaning cloth 56 against the roller bar 44 the cleaning cloth 56 is wrung out, i.e. dirty water is removed from the cleaning cloth 56. The dirty water simply flows down into the compartment 12. After having passed the roller bar 44 the cleaning cloth 56 is relatively dry, most of the dirty water associated with it being swept off.

While the carrier 36 and the cleaning cloth 56 are held in a "pushed down" position the pump 16 is operated using the handle 18. The pump 16 pumps dirty water contained in the compartment 12 to the filter unit 22. There, dirt particles are filtered out of the water. The extent to which particles are filtered out depends on the pores of filtering means provided inside the filter unit 22 (not shown).

Water freed of dirt is then pumped through the hose 26 to the pipes 29 and 29' mounted on the spray arm 28. Water is then led to the nozzles 32, facing the cleaning cloth 56, which is still held in the "pushed down" position.

Through the nozzles 32 water is sprayed directly onto the cleaning cloth 56, rinsing thoroughly the cleaning cloth 56. Rinsing water loaded with dirt flows down into the compartment 12. Most of the water flows down the side facing the nozzles 32, but some water may also pass through the hole 40 of the plate 59 connected to the cleaning cloth 56.

When the carrier 36 is pulled out of the structure 34 the cleaning cloth 56 is pressed to the roller bar 44 again and is freed from excessive water. The tool 58 can then be taken from the carrier 36 or a new round of rinsing may be performed by pushing the carrier 36.

Figure 4:
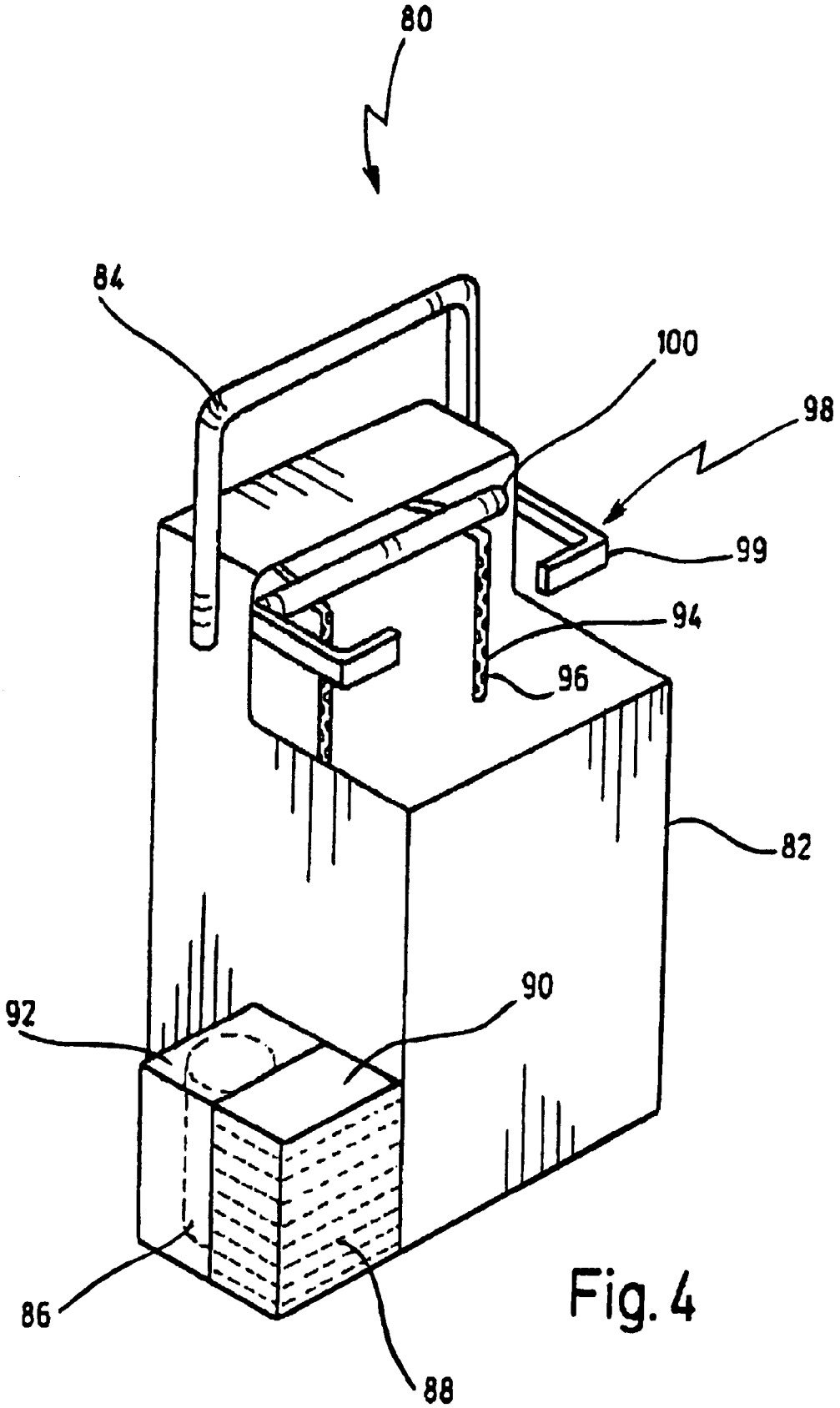
FIG. 4 shows schematically a simpler embodiment of a container according to the invention.
Figure 5:
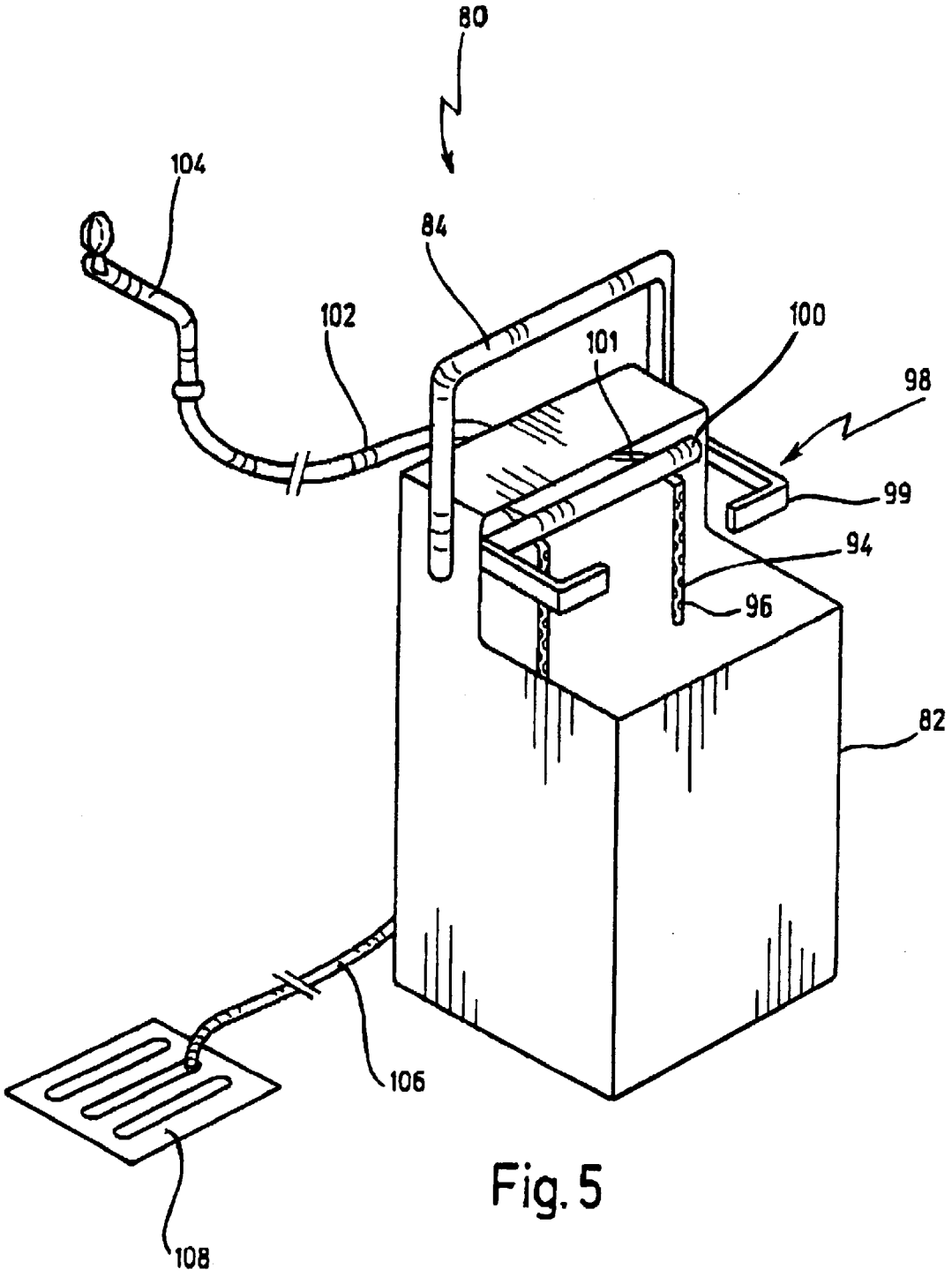
FIG. 5 shows schematically a similar embodiment of the container of FIG. 4 connected to a water tap.

A simpler embodiment of the container according to the invention is shown in FIGS. 4 and 5.

A container 80 is designed as a bucket comprising a single compartment 82. The container 80 may be carried around by the cleaning person using a handle 84 provided in the upper part of the compartment 82.

The container shown in FIG. 4 comprises a pump 86, for example an electrically operated pump, and a filter unit 88 in two separate further compartments 90 and 92 arranged at the outside of the container 80. The hoses connecting the compartments 82, 90 and 92 are not shown.

The container 80 further comprises two spray bars 94 arranged in the upper part of the comparment 82. The spray bars 94 comprise nozzles 96 simply provided as holes in this embodiment. The spray bars face a structure 98 adapted to receive a cleaning cloth. The structure 98 comprises two L-shaped arms 99.

Above the spray bars 94 a roller bar 100 is provided.

The container 80 shown in FIG. 5 does not contain a filter unit 88 and a pump 92, but is connected through hoses 101 and 102 to a water tap 104.

In the bottom part of the container 80 shown in FIG. 5 the compartment 82 is connected to a hose 106 leading to a drain 108.

Rinsing a cleaning cloth using the container 80 comprises inserting the cleaning cloth into the structure 98 surrounded by the L-shaped arms 99. During insertion the cleaning cloth can be mechanically pressed against the roller bar 100 so as to remove much of the dirty water before rinsing. The cleaning cloth then faces the spray bars 94 serving to spray fresh water directly onto the cleaning cloth.

The fresh water is either directly supplied by the water tap 104 (FIG. 5) or water contained in the compartment 82 is pumped by the pump 86 through the filter unit 88 (FIG. 4) and further guided to the spray bars 94.

Through the nozzles 96 water is sprayed onto the cleaning cloth flushing away dirt particles. In the embodiment shown in FIG. 5 the pressure of the water coming out of the water tap 104 is generally high enough to allow spraying of the water through nozzles 96 onto the surface of a cleaning cloth.

The dirty water flows down into the compartment 82 and is drained off through hose 106 (FIG. 5) or freed from dirt through filter unit 88 (FIG. 4).

For efficient rinsing the cleaning cloth can be moved up and down along the spray bars 94 and is then pulled out of the structure 98 again.

In the embodiment shown in FIG. 4 the pump 86 is electrically operated, for example by an electric motor. This motor can also serve to vibrate or stirr the water in the container 82, thus avoiding excessive settling down of dirt in the bottom part of the compartment 82.

Others skilled in the art will conceive of various modifications to the illustrated containers or buckets. The invention is not limited to any specific embodiment but encompasses all variations within the scope of the statements of the invention.

Therefore, what I claim is:

1. A container for use in rinsing out dirt from a cleaning cloth, comprising a compartment adapted to hold water, means for providing fresh water, a structure adapted to receive a cleaning cloth to be rinsed, and nozzles for spraying water free of dirt onto said cleaning cloth, wherein an array of nozzles are arranged along a spray arm or a spray bar in such a way that water is sprayed directly onto said cleaning cloth, rinsing thoroughly the cleaning cloth; and further including wringing means arranged for automatically wringing out the cleaning cloth while being inserted into or withdrawn from the container, said wringing means comprising a roller bar mounted at a top end of said structure adapted to receive the cleaning cloth to be rinsed; said structure comprising guiding means for guiding said cleaning cloth along the roller bar during inserting and during withdrawal of the cleaning cloth into and from the container, respectively.

2. The container of claim 1, wherein said spray arm or said spray bar extends substantially vertical within said container.

3. The container of claim 1, wherein said nozzles are arranged in a fixed position within said container.

4. The container of claim 1, wherein at least one nozzle is movably arranged within said container.

5. The container of claim 1, wherein several of said nozzles are mounted on a spray support.

6. The container of claim 5, wherein said spray support is detachably mounted onto said container.

7. The container of claim 1, wherein said structure adapted to receive said cleaning cloth comprises a carrier adapted to receive a tool having attached said cleaning cloth thereon.

8. The container of claim 7, wherein said carrier is movable between a first position retracted away from said container and a second position pushed into said container, the cleaning cloth being rinsed with water free of dirt in said second position of said carrier.

9. The container of claim 8, wherein a roller bar is mounted in face of said carrier at a distance providing a gap for wringing the cleaning cloth while moving the carrier.

10. The container of claim 1, wherein it further comprises a cover.

11. The container of claim 1, wherein it further comprises wheels.

12. The container of claim 1, wherein said means for providing fresh water comprises a fresh water inlet pipe connected to a hose leading to said nozzles and a water outlet pipe for discharging dirty water from said compartment.

13. The container of claim 1, wherein it further comprises a pump for pumping water from said compartment to said nozzles.

14. The container of claim 13, wherein said pump is an electrically operated pump.

15. The container of claim 1, wherein it further comprises a pump for pumping water from said compartment to said nozzle, and wherein said pump is a hand operated pump.

16. The container of claim 1, wherein it further comprises a pump for pumping water from said compartment to said nozzle, wherein said pump is a foot operated pump.

17. The container of claim 1, wherein said means for providing fresh water comprises filter means for filtering dirty water resulting from a rinsing process.

18. The container of claim 17, wherein said filter means are provided upstream of a pump for pumping water from said compartment to said nozzles.

19. The container of claim 1 characterized in that that means for providing fresh water comprising filter means for filtering dirty water resulting from said rinsing process, wherein said filter means are provided downstream of a pump, that pump serves for pumping water from said compartment to said nozzles.

20. The container of claim 1, wherein said means for providing fresh water comprises filter means for filtering dirty water resulting from the rinsing process, wherein said filter means comprises pores greater than microns in size.

21. The container of claim 1, wherein said means for providing fresh water comprises filter means for filtering dirty water resulting from the rinsing process, wherein said filter means comprises pores smaller than microns in size.

22. The container of claim 1, wherein said means for providing fresh water comprising a fresh water compartment and wherein at least one nozzle is designed as an outlet of said fresh water compartment allowing water to be splashed onto said cleaning cloth under gravity.

* * * * *